US007854026B2

(12) United States Patent
Phaneuf et al.

(10) Patent No.: US 7,854,026 B2
(45) Date of Patent: Dec. 21, 2010

(54) ATHLETIC EQUIPMENT ENABLING ENHANCED MOBILITY

(76) Inventors: Paul R. Phaneuf, 144 Cranwell Dr., Manchester, NH (US) 03109; Frank Warren, III, 49 Buttonwood Rd., Bedford, NH (US) 03110

( * ) Notice: Subject to any disclaimer, the term of this patent is extended or adjusted under 35 U.S.C. 154(b) by 7 days.

(21) Appl. No.: 12/061,214

(22) Filed: Apr. 2, 2008

(65) Prior Publication Data

US 2008/0244812 A1 Oct. 9, 2008

Related U.S. Application Data

(60) Provisional application No. 60/909,765, filed on Apr. 3, 2007.

(51) Int. Cl.
*A41D 27/26* (2006.01)

(52) U.S. Cl. ..... 2/461

(58) Field of Classification Search ..... 2/459, 2/461, 462–463, 44, 45, 268, 92, 455, 102, 2/16, 908

See application file for complete search history.

(56) References Cited

U.S. PATENT DOCUMENTS

| | | | | |
|---|---|---|---|---|
| 1,489,048 | A | 4/1924 | Wiley | |
| 1,862,441 | A | 6/1932 | Till | |
| 4,158,242 | A | 6/1979 | Mitchell | |
| 4,295,227 | A | 10/1981 | Mitchell | |
| 4,320,537 | A | 3/1982 | Mitchell | |
| 4,322,859 | A | 4/1982 | Mitchell | |
| 4,467,475 | A | 8/1984 | Gregory et al. | |
| 4,516,273 | A | 5/1985 | Gregory et al. | |
| 4,654,893 | A | 4/1987 | Meyers et al. | |
| 4,868,925 | A | 9/1989 | Mitchell | |
| 4,989,265 | A * | 2/1991 | Nipper et al. | 2/462 |
| 5,173,964 | A | 12/1992 | Ball et al. | |
| 6,845,522 | B2 * | 1/2005 | Beland | 2/461 |
| 2004/0210992 | A1 | 10/2004 | Morrow et al. | |

* cited by examiner

*Primary Examiner*—Tejash Patel
(74) *Attorney, Agent, or Firm*—Hayes Soloway P.C.

(57) ABSTRACT

A shoulder pad apparatus includes a chest plate. A shoulder cap is formed at an upper portion of the chest plate. A shoulder flap connects to the shoulder cap. An upper arm flap pivotably connects to the shoulder flap. At least one arcuate shell also may pivotably connect to the shoulder flap.

13 Claims, 8 Drawing Sheets

ATHLETIC EQUIPMENT ENABLING ENHANCED MOBILITY

CROSS-REFERENCE TO RELATED APPLICATION

This application claims priority to U.S. Provisional Application entitled, "ATHLETIC EQUIPMENT ENABLING ENHANCED MOBILITY," having Ser. No. 60/909,765 filed Apr. 3, 2007, which is entirely incorporated herein by reference.

FIELD OF THE INVENTION

The present invention is generally related to athletic equipment and more particularly is related to shoulder pads adapted to allow greater arm mobility.

BACKGROUND OF THE INVENTION

FIG. 1 is a front view of a shoulder pad 10, in accordance with athletic equipment known in the prior art. The shoulder pad 10 is similar, for instance, to the shoulder pad disclosed in U.S. Pat. No. 4,158,242 to Mitchell. The shoulder pad 10 includes a chest plate 12 held together at the front by a lace 14. The chest plate 12 is attached to chest padding 16 and neck padding 18 at an interior side of the chest plate 12. A shoulder cap 20 is either formed integral with the chest plate 12 at a top of the chest plate 12 or is rigidly connected to the chest plate 12 at the top of the chest plate 12. A shoulder flap 22 rests on the shoulder cap 20 and is connected to the shoulder cap 20 by a main hinge strap 24. An upper arm flap 26 is also connected to the shoulder cap 20 by an ancillary hinge strap (not shown). Snubber straps 28 further connect the shoulder flap 22 to the shoulder cap 20, restricting movement of the shoulder flap 22 relative to the shoulder cap 20.

FIG. 2 is a front view of the shoulder pad 10 of FIG. 1, in accordance with athletic equipment known in the prior art. As shown in FIG. 2, a left upper arm flap 26 has been raised to its fullest extent by user's arm. More specifically, the upper arm flap 26 is mobile as it is only connected to the shoulder cap 20 by the ancillary hinge strap (not shown). However, mobility of the upper arm flap 26 is limited by the limited mobility of the shoulder flap 22. The mobility of the shoulder flap 22 is limited by the combination of the main hinge strap 24 and the snubber straps 28. For a quarterback who needs to raise his arm on every pass attempt or for a receiver or pass defender who regularly needs to reach over his head to reach a pass, this shoulder pad 10 constricts the ability of the player to perform at the highest level.

Thus, a heretofore unaddressed need exists in the industry to address the aforementioned deficiencies and inadequacies.

SUMMARY OF THE INVENTION

Embodiments of the present invention provide a system and method for providing a shoulder pad apparatus. Briefly described, in architecture, one embodiment of the system, among others, can be implemented as follows. The system contains a chest plate. A shoulder cap is formed at an upper portion of the chest plate. A shoulder pad subassembly connects to the shoulder cap. The shoulder pad subassembly includes a shoulder flap connected to the shoulder cap and an upper arm flap pivotably connected to the shoulder flap.

The present invention can also be viewed as providing methods for using the shoulder pad apparatus. In this regard, one embodiment of such a method, among others, can be broadly summarized by the following steps: wearing the shoulder pad apparatus on at least one shoulder of a user, the shoulder pad apparatus including a chest plate, a shoulder cap at an upper portion of the chest plate, and a shoulder flap connected to the shoulder cap; raising an arm of the user above the shoulder cap; and pivoting an upper arm flap on the shoulder flap.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
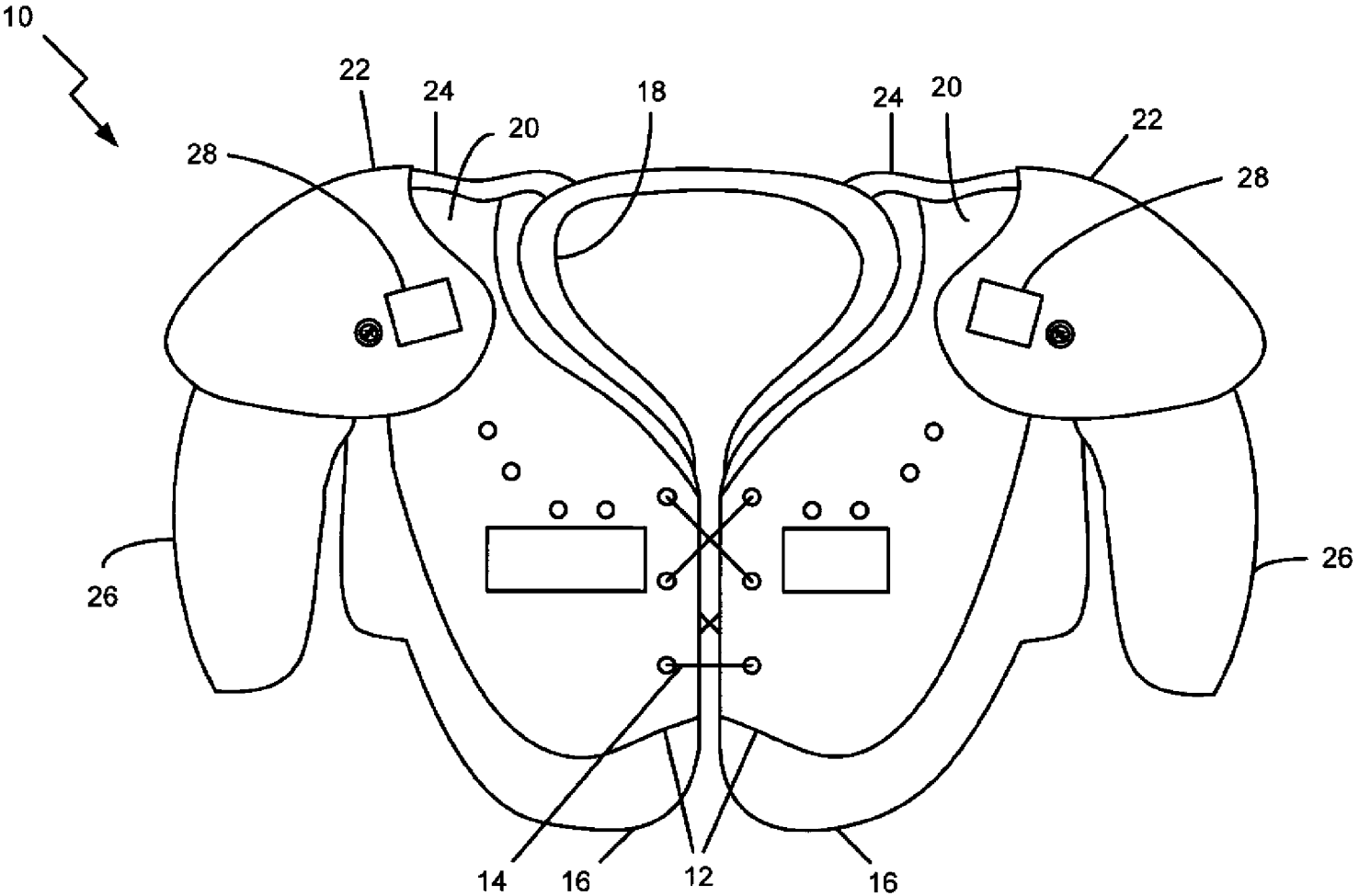
FIG. 1 PRIOR ART
FIG. 1 is a front view of a shoulder pad, in accordance with athletic equipment known in the prior art.
Figure 2:
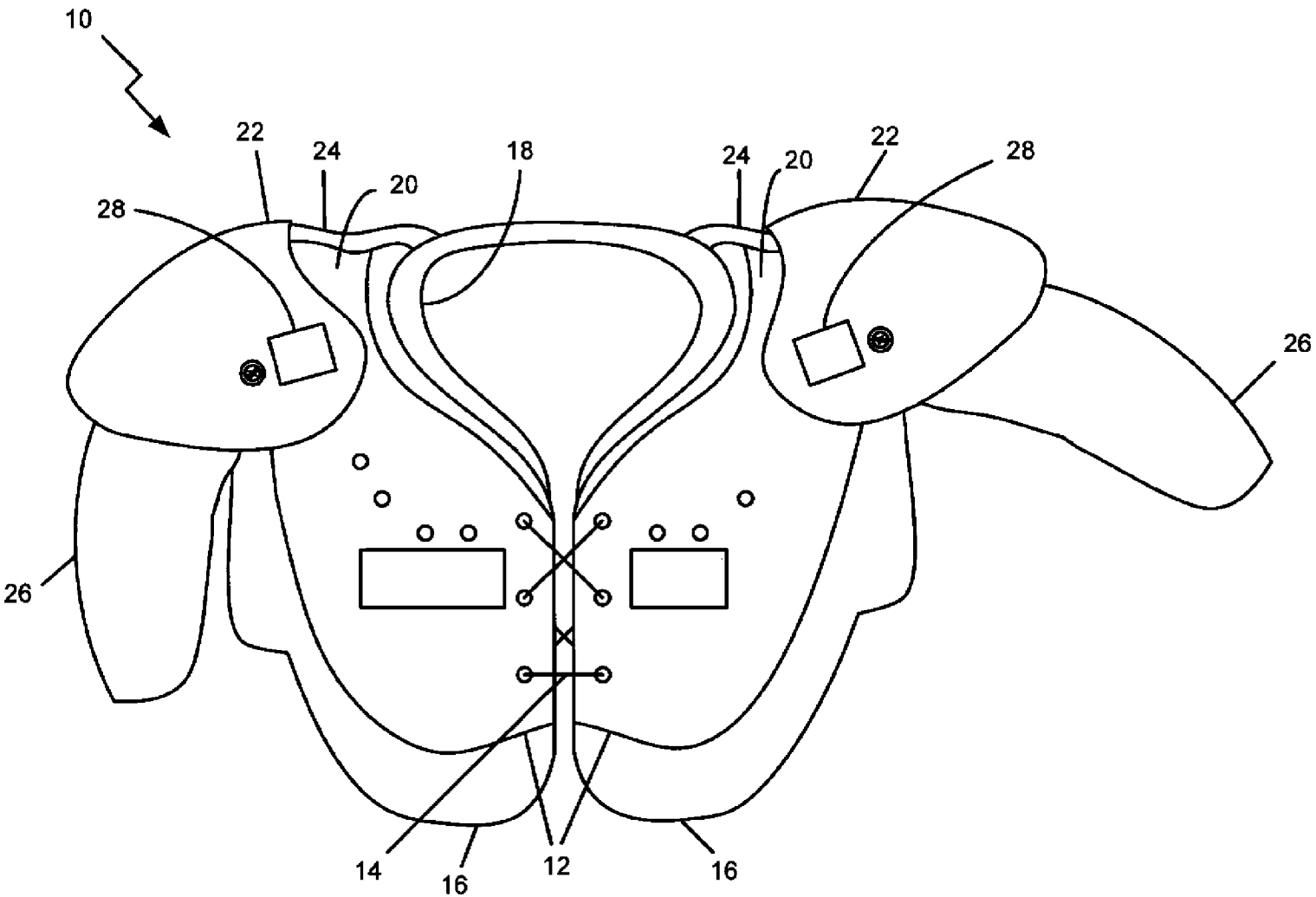
FIG. 2 PRIOR ART
FIG. 2 is a front view of the shoulder pad of FIG. 1, in accordance with athletic equipment known in the prior art.
Figure 3:
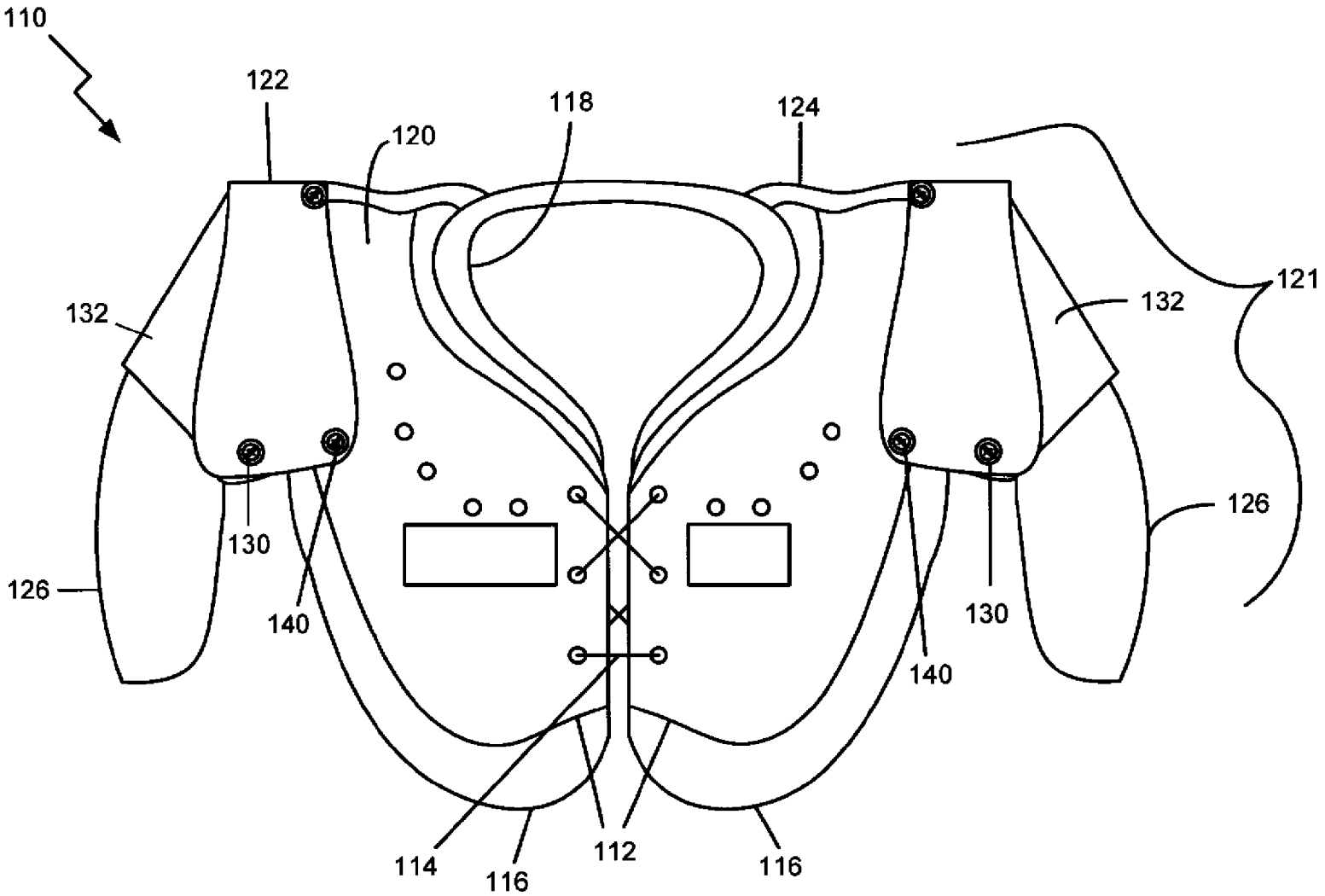
FIG. 3 is a front view of a shoulder pad apparatus, in accordance with a first exemplary embodiment of the present invention.

FIG. 3 is a front view of a shoulder pad apparatus 110, in accordance with a first exemplary embodiment of the present invention. The shoulder pad apparatus 110 includes a chest plate 112. A shoulder cap 120 is formed at an upper portion of the chest plate 112. A shoulder subassembly 121 connects to the shoulder cap 120. The shoulder subassembly 121 includes a shoulder flap 122 connected to the shoulder cap 120 and an upper arm flap 126 pivotably connected to the shoulder flap 122.

As can be seen in FIG. 3, the shoulder pad apparatus 110 may have many of the elements of prior art. Specifically, the shoulder pad apparatus 110 may include a chest plate 112 held together at the front by a lace 114. The chest plate 112 may be attached to chest padding 116 and neck padding 118 at an interior side of the chest plate 112. The shoulder cap 120 may be either formed integral with the chest plate 112 at a top of the chest plate 112 or may be rigidly connected to the chest plate 112 at a top of the chest plate 112. The shoulder flap 122 may rest on the shoulder cap 120 and may be connected to the shoulder cap 120 by a restrainer strap 124. The restrainer strap 124 may be a cloth or elastomeric material.

The shoulder flap 122 may further be attached to the chest plate 112 by chest hinge pins 140. Shoulder flap pins 130 pivotably connect the upper arm flap 126 to the shoulder flap 122. The upper arm flap 126 is integrally connected to an upper shell 132.

Figure 4:
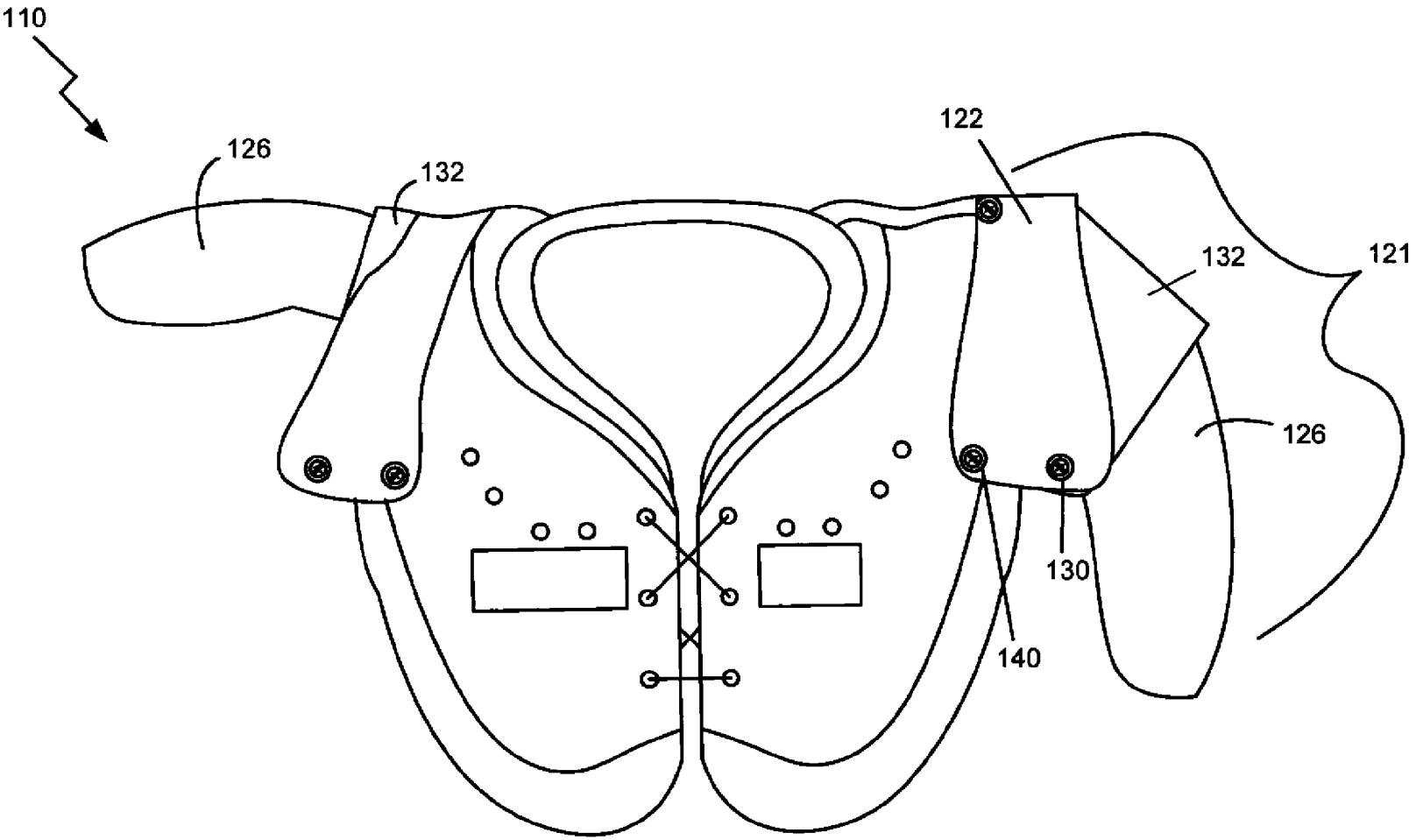
FIG. 4 is another front view of the shoulder pad apparatus of FIG. 3, in accordance with the first exemplary embodiment of the present invention.

FIG. 4 is another front view of the shoulder pad apparatus 110 of FIG. 3, in accordance with the first exemplary embodiment of the present invention. FIG. 4 illustrates one of the upper arm flaps 126 being raised, as would be the case when a player raised their arm. As can be seen, the upper shell 132 pivots on the shoulder flap pins 130 into and beneath the shoulder flap 122 and the shoulder flap 122, to a lesser extent, pivots on the chest hinge pins 140. This arrangement is believed to increase the upward range of motion for the arm of a player.

Figure 5:
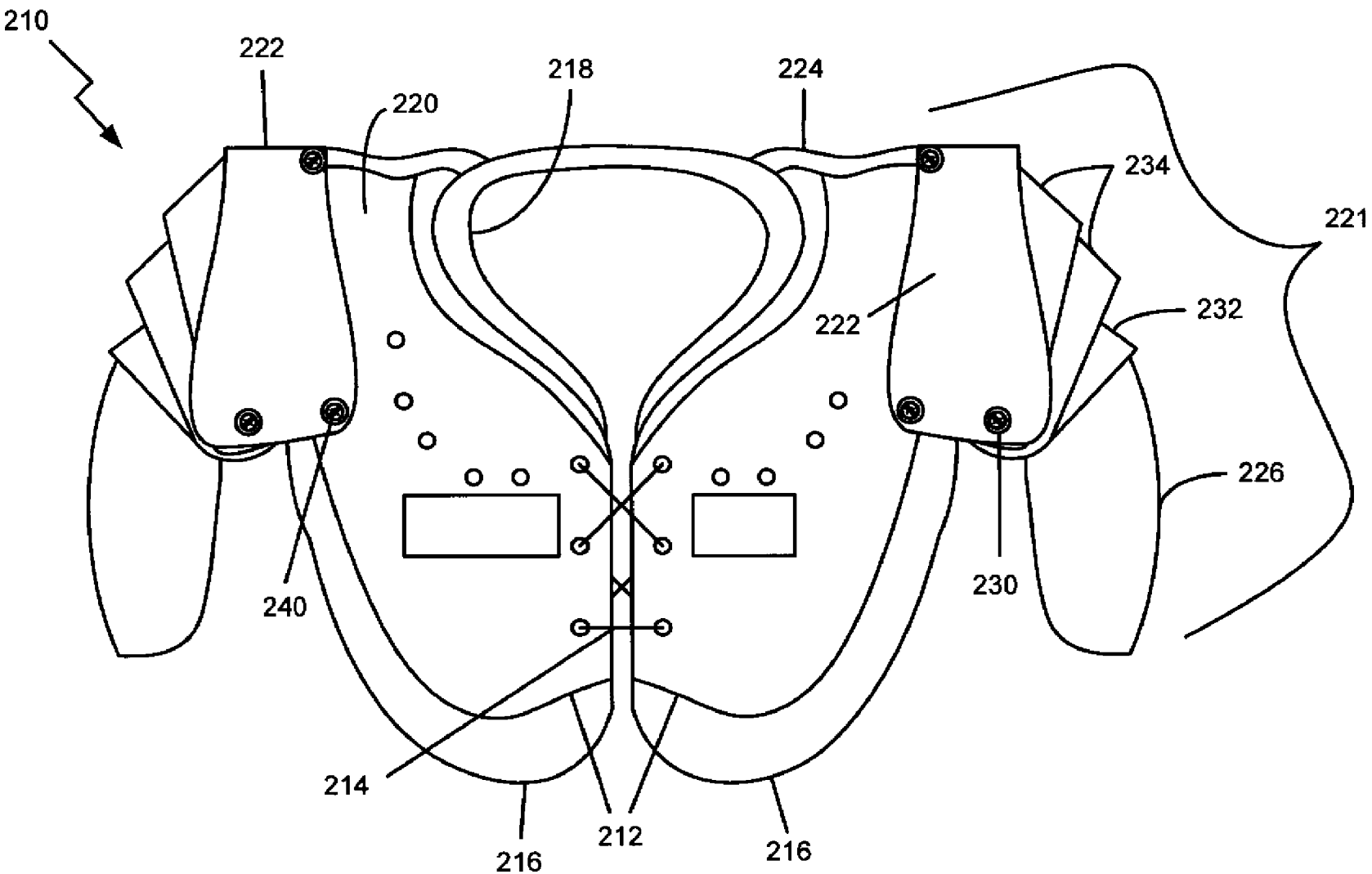
FIG. 5 is a front view of a shoulder pad apparatus, in accordance with a second exemplary embodiment of the present invention.

FIG. 5 is a front view of a shoulder pad apparatus 210, in accordance with a second exemplary embodiment of the present invention. The shoulder pad apparatus 210 includes a chest plate 212. A shoulder cap 220 is formed at an upper portion of the chest plate 212. A shoulder subassembly 221 connects to the shoulder cap 220. The shoulder subassembly 221 includes a shoulder flap 222 connected to the shoulder cap 220, at least one arcuate shell 234 pivotably connected to the shoulder flap 222, and an upper arm flap 226 pivotably connected to the shoulder flap 222.

As can be seen in FIG. 5, the shoulder pad apparatus 210 may have many of the elements of prior art. Specifically, the shoulder pad apparatus 210 may include a chest plate 212 held together at the front by a lace 214. The chest plate 212 may be attached to chest padding 216 and neck padding 218 at an interior side of the chest plate 212. The shoulder cap 220 may be either formed integral with the chest plate 212 at a top of the chest plate 212 or may be rigidly connected to the chest plate 212 at a top of the chest plate 212. The shoulder flap 222 may rest on the shoulder cap 220 and may be connected to the shoulder cap 220 by a restrainer strap 224.

The shoulder flap 222 may further be attached to the chest plate 212 by chest hinge pins 240. Shoulder flap pins 230 pivotably connect the upper arm flap 226 to the shoulder flap 222. The shoulder flap pins 230 also pivotably connect the arcuate shells 234 to the shoulder flap 222. The upper arm flap 226 is integrally connected to an upper shell 232.

Figure 6:
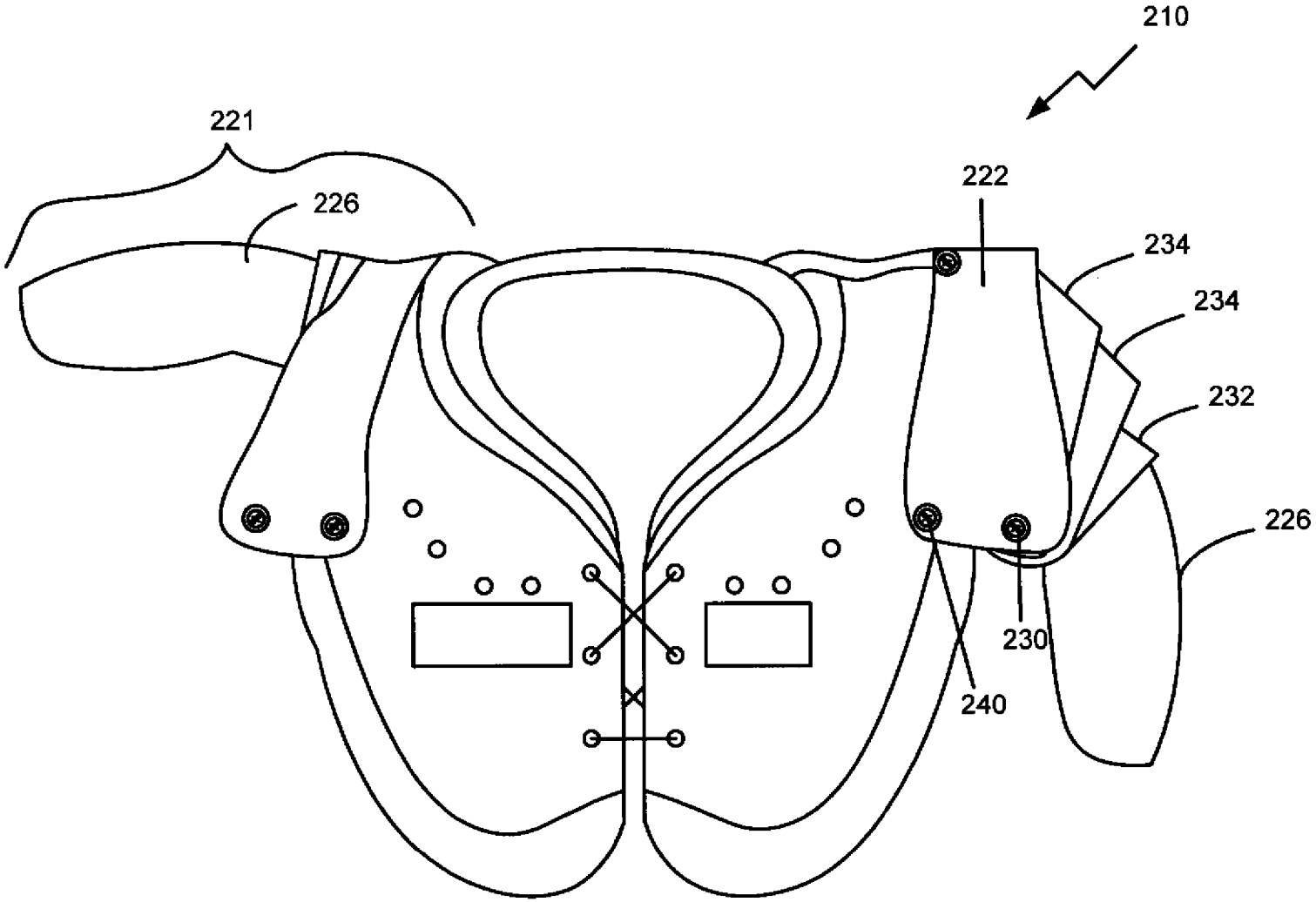
FIG. 6 is another front view of the shoulder pad apparatus of FIG. 5, in accordance with the second exemplary embodiment of the present invention.

FIG. 6 is another front view of the shoulder pad apparatus 210 of FIG. 5, in accordance with the second exemplary embodiment of the present invention. FIG. 6 illustrates one of the upper arm flaps 226 being raised, as would be the case when a player raises their arm. As can be seen, the upper shell 232 pivots on the shoulder flap pins 230 into and beneath the shoulder flap 222, the arcuate shells 234 pivot on the shoulder flap pins 230 into and beneath the shoulder flap 222, and the shoulder flap 222, to a lesser extent, pivots on the chest hinge pins 240. This arrangement is believed to increase the upward range of motion for the arm of a player. Further, as compared to the first exemplary embodiment, the second exemplary embodiment can be less bulky in the shoulders. The shoulder flaps 222 and the upper shell 232 require less space and still give full coverage to the shoulder (along with the arcuate shells 234).

The arcuate shells 234 may interact with each other as well as interacting with the upper shell 232 such that when an arm of a player is lowered, the upper shell 232 and upper arm flap 226 are lowered by gravity, or mechanical connection to the arm, and pull the arcuate shells 234, causing them to fan out and provide full protection to the shoulder of the player. Those having ordinary skill in the art will appreciate a variety of possibilities exist for providing this mechanical interaction and all possibilities are considered to be within the scope of the present invention.

Figure 7:
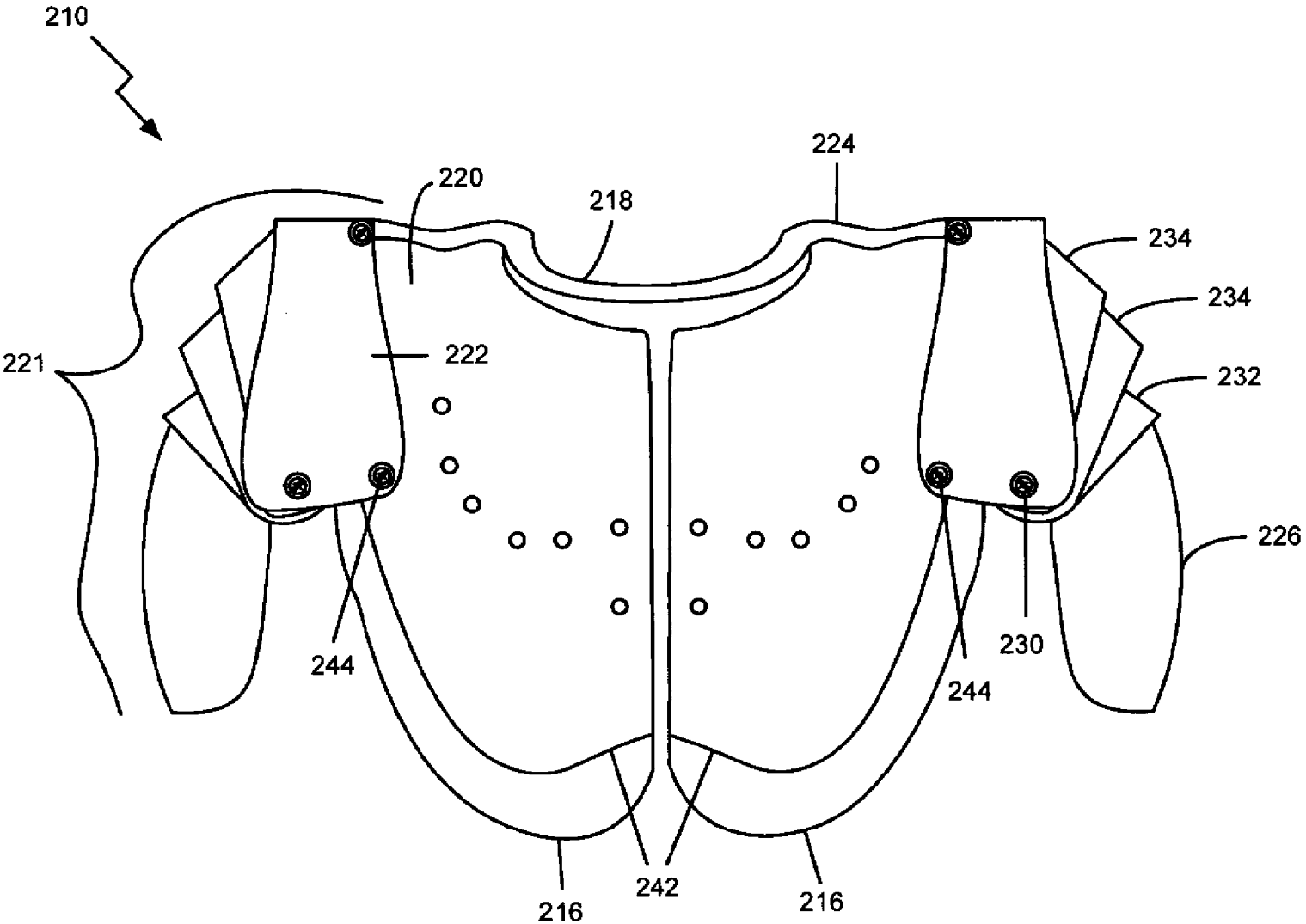
FIG. 7 is a back view of the shoulder pad apparatus of FIG. 5, in accordance with the second exemplary embodiment of the present invention.

FIG. 7 is a back view of the shoulder pad apparatus 210 of FIG. 5, in accordance with the second exemplary embodiment of the present invention. The shoulder pad apparatus 210 includes a back plate 242. The shoulder cap 220 is formed at an upper portion of the back plate 242. The shoulder flap 222 connects to the shoulder cap 220. At least one arcuate shell 234 pivotably connects to the shoulder flap 222. An upper arm flap 226 pivotably connects to the shoulder flap 222. The shoulder flap 222 may further be attached to the back plate 242 by back hinge pins 244. Shoulder flap pins 230 pivotably connect the upper arm flap 226 to the shoulder flap 222. The shoulder flap pins 230 also pivotably connect the arcuate shells 234 to the shoulder flap 222. The upper arm flap 226 is integrally connected to an upper shell 232.

Figure 8:
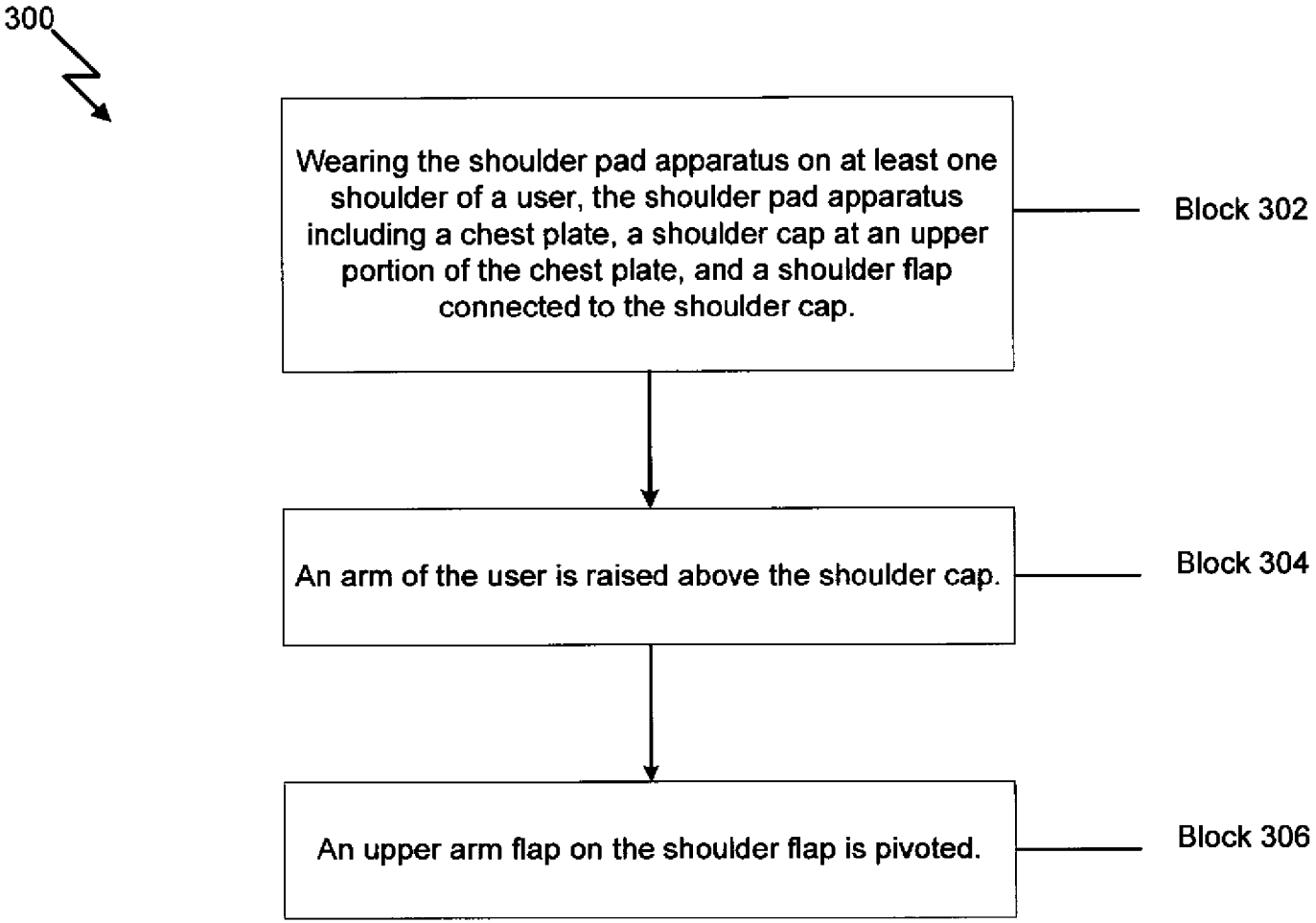
FIG. 8 is a flowchart illustrating an exemplary method of using the shoulder pad apparatus shown in FIG. 3, in accordance with the first exemplary embodiment of the invention.

FIG. 8 is a flowchart 300 illustrating a method of using the above-mentioned shoulder pad apparatus 110 in accordance with the first exemplary embodiment of the invention. It should be noted that any process descriptions or blocks in flow charts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

As is shown by block 302, wearing the shoulder pad apparatus 110 on at least one shoulder of a user, the shoulder pad apparatus 110 including a chest plate 112, a shoulder cap 120 at an upper portion of the chest plate 112, and a shoulder flap 122 connected to the shoulder cap 120. An arm of the user is raised above the shoulder cap 120 (block 304). An upper arm flap 126 on the shoulder flap 122 is pivoted (block 306).

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A shoulder pad apparatus, comprising:

a chest plate;

a shoulder cap at an upper portion of the chest plate;

a shoulder flap connected to the shoulder cap;

an upper arm flap pivotably connected to the shoulder flap; and at least one arcuate shell pivotably connected to the shoulder flap, wherein the at least one arcuate shell is connected to the shoulder flap at a first location on a front of the shoulder flap and at a second location on a back of the shoulder flap.

2. The shoulder pad apparatus of claim 1, wherein the shoulder cap is integral with the chest plate.

3. The shoulder pad apparatus of claim 1, further comprising a plurality of arcuate shells pivotably connected to the shoulder flap.

4. The shoulder pad apparatus of claim 1, wherein the arcuate shell is at least as narrow as the shoulder flap.

5. The shoulder pad apparatus of claim 1, wherein the at least one arcuate shell is connected to the shoulder flap at a first hinge pin on a front of the shoulder flap and at a second hinge pin on a back of the shoulder flap.

6. The shoulder pad apparatus of claim 1, wherein the shoulder flap is pivotably connected to the shoulder cap.

7. The shoulder pad apparatus of claim 1, wherein the upper arm flap is connected to the shoulder flap at a first hinge pin on a front of the shoulder flap and at a second hinge pin on a back of the shoulder flap.

8. A shoulder pad apparatus, comprising:

a chest plate;

a shoulder cap at an upper portion of the chest plate;

a shoulder flap connected to the shoulder cap;

at least one arcuate shell pivotably connected to the shoulder flap;

an upper arm flap pivotably connected to the shoulder flap; and a plurality of arcuate shells, wherein each arcuate shell of the plurality of arcuate shells is connected to the shoulder flap at a first hinge pin on a front of the shoulder flap and at a second hinge pin on a back of the shoulder flap.

9. The shoulder pad apparatus of claim 1, wherein at least one of the shoulder flap, the upper arm flap and the at least one arcuate shell are situated to recoil within the shoulder cap, thereby allowing a greater range of motion of an arm.

10. A method of using a shoulder pad apparatus, the method comprising:

wearing the shoulder pad apparatus on at least one shoulder of a user, the shoulder pad apparatus including a chest plate, a shoulder cap at an upper portion of the chest plate, and a shoulder flap connected to the shoulder cap;

raising an arm of the user above the shoulder cap;

pivoting an upper arm flap on the shoulder flap; and pivoting a plurality of arcuate shells on the shoulder flap.

11. The method of claim 10, further comprising pivoting the plurality of arcuate shells along at least two locations on the shoulder flap.

12. The method of claim 10, further comprising pivoting the shoulder flap on the shoulder cap.

13. The method of claim 10, further comprising the step of throwing a football with the arm raised above the shoulder cap.

* * * * *